US010260160B2

(12) United States Patent
Sun et al.

(10) Patent No.: US 10,260,160 B2
(45) **Date of Patent: *Apr. 16, 2019**

(54) HIGH PURITY METALLIC TOP COAT FOR SEMICONDUCTOR MANUFACTURING COMPONENTS

(71) Applicant: Applied Materials, Inc., Santa Clara, CA (US)

(72) Inventors: Jennifer Y. Sun, Mountain View, CA (US); Vahid Firouzdor, San Mateo, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/847,240

(22) Filed: Dec. 19, 2017

(65) Prior Publication Data

US 2018/0105938 A1 Apr. 19, 2018

Related U.S. Application Data

(60) Continuation of application No. 15/595,888, filed on May 15, 2017, now Pat. No. 9,879,348, which is a (Continued)

(51) Int. Cl.
*C25D 11/34* (2006.01)
*C25D 11/04* (2006.01)
(Continued)

(52) U.S. Cl.
CPC ..... *C25D 11/34* (2013.01); *C23C 24/04* (2013.01); *C23C 28/321* (2013.01);
(Continued)

(58) Field of Classification Search
CPC ..... C25D 11/04; C23C 24/04
See application file for complete search history.

(56) References Cited

U.S. PATENT DOCUMENTS 3,151,948 A 10/1964 Steeves
3,969,195 A 7/1976 Dotzer et al.
(Continued)

FOREIGN PATENT DOCUMENTS

CN 102864479 A 1/2013
DE 10248118 A1 4/2004
(Continued)

OTHER PUBLICATIONS

Ohgai et al., "Template Synthesis and Magnetoresistance Property of Ni and Co Single Nanowires Electrodeposited into nanopores with a Wide Range of Aspect Ratios," J. Phys. D: Appl. Phys., Nov. 25, 2003, vol. 36, pp. 3109-3114.
(Continued)

*Primary Examiner* — Xiao S Zhao
(74) *Attorney, Agent, or Firm* — Lowenstein Sandler LLP

(57) ABSTRACT

A component for a manufacturing chamber comprises a coating and an anodization layer on the coating. The anodization layer has a thickness of about 2-10 mil. The anodization layer comprises a low porosity bottom layer portion having a porosity that is less than about 40-50% and a porous columnar top layer portion having a porosity of about 40-40% and comprising a plurality of columnar nanopores having a diameter of about 10-50 nm.

19 Claims, 5 Drawing Sheets

Related U.S. Application Data division of application No. 14/079,586, filed on Nov. 13, 2013, now Pat. No. 9,663,870.

(51) Int. Cl.

| | |
|---|---|
| ***C25D 11/16*** | (2006.01) |
| ***C25D 11/18*** | (2006.01) |
| ***C25D 11/26*** | (2006.01) |
| ***C23C 24/04*** | (2006.01) |
| ***C23C 28/00*** | (2006.01) |

(52) U.S. Cl.

CPC ..... *C23C 28/322* (2013.01); *C23C 28/345* (2013.01); *C23C 28/3455* (2013.01); *C25D 11/04* (2013.01); *C25D 11/16* (2013.01); *C25D 11/18* (2013.01); *C25D 11/26* (2013.01); *Y10T 428/12736* (2015.01); *Y10T 428/12743* (2015.01); *Y10T 428/12757* (2015.01); *Y10T 428/12764* (2015.01)

(56) References Cited

U.S. PATENT DOCUMENTS

| | | | |
|---|---|---|---|
| 4,430,387 | A | 2/1984 | Nakagawa et al. |
| 4,465,561 | A | 8/1984 | Nguyen et al. |
| 4,624,752 | A | 11/1986 | Arrowsmith et al. |
| 4,883,541 | A | 11/1989 | Tadros |
| 4,925,738 | A | 5/1990 | Tsuya et al. |
| 4,948,475 | A | 8/1990 | Doetzer et al. |
| 5,069,938 | A | 12/1991 | Lorimer et al. |
| 5,104,514 | A | 4/1992 | Quartarone |
| 5,192,610 | A | 3/1993 | Lorimer et al. |
| 5,494,713 | A | 2/1996 | Ootuki |
| 5,779,848 | A | 7/1998 | Aruga |
| 6,027,629 | A | 2/2000 | Hisamoto et al. |
| 6,166,172 | A | 12/2000 | McCullough et al. |
| 6,444,304 | B1 | 9/2002 | Hisamoto et al. |
| 6,466,881 | B1 | 10/2002 | Shih et al. |
| 6,521,046 | B2 | 2/2003 | Tanaka et al. |
| 6,659,331 | B2 | 12/2003 | Thach et al. |
| 6,682,627 | B2 | 1/2004 | Shamouilian et al. |
| 6,686,053 | B2 | 2/2004 | Wada et al. |
| 6,776,873 | B1 | 8/2004 | Sun et al. |
| 7,005,194 | B2 | 2/2006 | Wada et al. |
| 7,033,447 | B2 | 4/2006 | Lin et al. |
| 7,048,814 | B2 | 5/2006 | Lin et al. |
| 7,055,732 | B2 | 6/2006 | Thach et al. |
| 7,732,056 | B2 | 6/2010 | Bhatnagar et al. |
| 8,067,067 | B2 | 11/2011 | Sun et al. |
| 8,124,240 | B2 | 2/2012 | Ohmi et al. |
| 8,128,750 | B2 | 3/2012 | Kenworthy et al. |
| 8,129,029 | B2 | 3/2012 | Sun et al. |
| 8,206,833 | B2 | 6/2012 | Ohmi et al. |
| 8,282,987 | B2 | 10/2012 | Kenworthy et al. |
| 8,591,986 | B1 | 11/2013 | Ajdelsztajn et al. |
| 8,999,475 | B2 | 4/2015 | Mitsuhashi |
| 9,012,030 | B2 | 4/2015 | Han et al. |
| 9,123,651 | B2 | 9/2015 | Shih et al. |
| 9,337,002 | B2 | 5/2016 | Daugherty et al. |
| 9,528,176 | B2 | 12/2016 | Mizuno et al. |
| 9,663,870 | B2 | 5/2017 | Sun et al. |
| 2003/0044714 | A1 | 3/2003 | Teraoka et al. |
| 2003/0047464 | A1 | 3/2003 | Sun et al. |
| 2003/0056897 | A1 | 3/2003 | Shamouilian et al. |
| 2004/0124280 | A1 | 7/2004 | Shih et al. |
| 2004/0126499 | A1 | 7/2004 | Heinrich et al. |
| 2004/0137299 | A1 | 7/2004 | Mazza et al. |
| 2004/0221959 | A1 | 11/2004 | Choi et al. |
| 2005/0037193 | A1 | 2/2005 | Sun et al. |
| 2006/0019035 | A1 | 1/2006 | Munz et al. |
| 2006/0024517 | A1 | 2/2006 | Doan et al. |
| 2006/0060472 | A1 | 3/2006 | Tomita et al. |
| 2006/0093736 | A1 | 5/2006 | Raybould et al. |
| 2006/0234396 | A1 | 10/2006 | Tomita et al. |
| 2007/0012657 | A1 | 1/2007 | O'Donnell et al. |
| 2008/0029032 | A1 | 2/2008 | Sun et al. |
| 2008/0223725 | A1 | 9/2008 | Han et al. |
| 2008/0241517 | A1 | 10/2008 | Kenworthy et al. |
| 2008/0283408 | A1 | 11/2008 | Nishizawa |
| 2009/0050485 | A1 | 2/2009 | Wada et al. |
| 2009/0145769 | A1 | 6/2009 | Tsuda |
| 2009/0298251 | A1 | 12/2009 | Choi et al. |
| 2010/0155251 | A1 | 6/2010 | Bogue et al. |
| 2010/0170937 | A1 | 7/2010 | Calla |
| 2010/0330390 | A1 | 12/2010 | Ohmi et al. |
| 2011/0020665 | A1 | 1/2011 | Serafin et al. |
| 2011/0168210 | A1 | 7/2011 | Tabata et al. |
| 2011/0206833 | A1 | 8/2011 | Sexton et al. |
| 2011/0220289 | A1 | 9/2011 | Tanaka et al. |
| 2012/0103526 | A1 | 5/2012 | Ouye et al. |
| 2012/0138472 | A1 | 6/2012 | Han et al. |
| 2012/0247961 | A1 | 10/2012 | Ohmi et al. |
| 2013/0008796 | A1 | 1/2013 | Silverman et al. |
| 2014/0110145 | A1 | 4/2014 | Elie et al. |
| 2014/0120312 | A1 | 5/2014 | He et al. |
| 2014/0272459 | A1 | 9/2014 | Daugherty et al. |
| 2014/0315392 | A1 | 10/2014 | Xu et al. |
| 2015/0064450 | A1 | 3/2015 | Sun et al. |
| 2015/0203981 | A1 | 7/2015 | Mitsuhashi |
| 2015/0337450 | A1 | 11/2015 | Shih et al. |
| 2015/0376810 | A1 | 12/2015 | Browning et al. |
| 2016/0002811 | A1 | 1/2016 | Sun et al. |

FOREIGN PATENT DOCUMENTS

| | | | |
|---|---|---|---|
| JP | H01-156496 | A | 6/1989 |
| JP | H05129467 | A | 5/1993 |
| JP | H09-010577 | A | 1/1997 |
| JP | 2000-178790 | A | 6/2000 |
| JP | 2008-240024 | A | 1/2008 |
| JP | 2008-303442 | A | 12/2008 |
| JP | 2090-099853 | A | 5/2009 |
| KR | 100607790 | | 8/2006 |
| KR | 10-2006-0111201 | A | 10/2006 |
| KR | 10-2007-0001722 | A | 1/2007 |
| KR | 10-2012-0077375 | A | 7/2012 |
| WO | 2009031841 | | 12/2009 |

OTHER PUBLICATIONS

Tan et al., "High Aspect Ratio Microstructures on Porous Anodic Aluminum Oxide," IEEE, Jan. 1995, pp. 267-272.

Paredes et al., "The Effect of Roughness and Pre-Heating of the Substrate on the Morphology of Aluminum Coatings Deposited by Thermal Spraying," Surface & Coatings Technology, Sep. 8, 2005, vol. 200, pp. 3049-3055.

International Search Report & Written Opinion of the International Searching Authority dated Jan. 29, 2015, in International Application No. PCT/US2014/065078.

HIGH PURITY METALLIC TOP COAT FOR SEMICONDUCTOR MANUFACTURING COMPONENTS

RELATED APPLICATIONS

This present application is a continuation of U.S. patent application Ser. No. 15/595,888, filed May 15, 2017, which is a divisional of U.S. patent application Ser. No. 14/079,586, filed Nov. 13, 2013, issued as U.S. Pat. No. 9,663,870, both of which are herein incorporated by reference.

TECHNICAL FIELD

Embodiments of the present disclosure relate, in general, to metallic coatings on semiconductor manufacturing components and to a process for applying a metallic coating to a substrate.

BACKGROUND

In the semiconductor industry, devices are fabricated by a number of manufacturing processes producing structures of an ever-decreasing size. Some manufacturing processes such as plasma etch and plasma clean processes expose a substrate to a high-speed stream of plasma to etch or clean the substrate. The plasma may be highly corrosive, and may corrode processing chambers and other surfaces that are exposed to the plasma. This corrosion may generate particles, which frequently contaminate the substrate that is being processed, contributing to device defects (i.e., on-wafer defects, such as particles and metal contamination).

As device geometries shrink, susceptibility to defects increases and allowable levels of particle contamination may be reduced. To minimize particle contamination introduced by plasma etch and/or plasma clean processes, chamber materials have been developed that are resistant to plasmas. Different materials provide different material properties, such as plasma resistance, rigidity, flexural strength, thermal shock resistance, and so on. Also, different materials have different material costs. Accordingly, some materials have superior plasma resistance, other materials have lower costs, and still other materials have superior flexural strength and/or thermal shock resistance.

SUMMARY

In one embodiment, a method includes providing a component for a manufacturing chamber, loading the component into a deposition chamber, cold spray coating a metal powder on the component to form a coating on the component, and anodizing the coating to form an anodization layer.

The method can also include polishing the component such that an average surface roughness of the component is less than about 20 micro-inches prior to anodizing the coating. The metal powder being cold spray coated on to the component can have a velocity in a range from about 100 m/s to about 1500 m/s. The powder can be sprayed via a carrier gas of Nitrogen or Argon.

The method can include heating the component after cold spray coating to a temperature in a range from about 200 degrees C. to about 1450 degrees C. for more than about 30 minutes to form a barrier layer between the component and the coating.

The coating can have a thickness in a range from about 0.1 mm to about 40 mm. The component can include Aluminum, an Aluminum alloy, stainless steel, Titanium, a Titanium alloy, Magnesium, or a Magnesium alloy. The metal powder can include Aluminum, an Aluminum alloy, Titanium, a Titanium alloy, Niobium, a Niobium alloy, Zirconium, a Zirconium alloy, Copper, or a Copper alloy.

About 1 to about 50 percent of the coating can be anodized to form the anodization layer. The component can be a showerhead, a cathode sleeve, a sleeve liner door, a cathode base, a chamber line, or an electrostatic chuck base.

In one embodiment an article includes a component for a manufacturing chamber for plasma etching, a metal coating on the component, and an anodization layer formed of the coating.

BRIEF DESCRIPTION OF THE DRAWINGS

The present disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

DETAILED DESCRIPTION OF EMBODIMENTS

Embodiments of the disclosure are directed to a process for applying a coating to a substrate, such as a component for use in a semiconductor manufacturing chamber. A component for use in a semiconductor manufacturing chamber can be cold spray coated with a metal powder to form a coating on the component, and the coating can be anodized to form an anodization layer. Cold spray coating of metal powders can provide a dense and conforming coating that has increased resistance to aggressive plasma chemistries. The coating can be formed of high purity materials to reduce the metal contamination level inside the chamber. A coating with an anodization layer can increase the lifetime of the component and decrease on-wafer defects during semiconductor manufacturing because it is erosion resistant. Therefore, levels of particle contamination can be reduced.

The component that is cold spray coated can be formed of Aluminum, an Aluminum alloy, stainless steel, Titanium, a Titanium alloy, Magnesium, or a Magnesium alloy. The component can be a showerhead, a cathode sleeve, a sleeve liner door, a cathode base, a chamber line, an electrostatic chuck base, or another component of a processing chamber. Also, the component can be polished to lower an average surface roughness prior to anodizing the coating. Additionally, the component can be heated after cold spray coating of the coating to form a barrier layer between the component and the coating.

The metal powder being cold spray coated on to the component can have a velocity in a range from about 100 m/s to about 1500 m/s and can be sprayed via a carrier gas of Nitrogen or Argon. The coating can have a thickness in a range from about 0.1 mm to about 40 mm. The metal powder can be Aluminum, an Aluminum alloy, Titanium, a Titanium alloy, Niobium, a Niobium alloy, Zirconium, a Zirconium alloy, Copper, or a Copper alloy. About 1-to-50 percent of the coating can be anodized to form the anodization layer.

When the terms "about" and "approximately" are used herein, these are intended to mean that the nominal value presented is precise within ±10%. Note also that some embodiments are described herein with reference to components used in plasma etchers for semiconductor manufacturing. However, it should be understood that such plasma etchers may also be used to manufacture micro-electro-mechanical systems (MEMS) devices.

Figure 1:
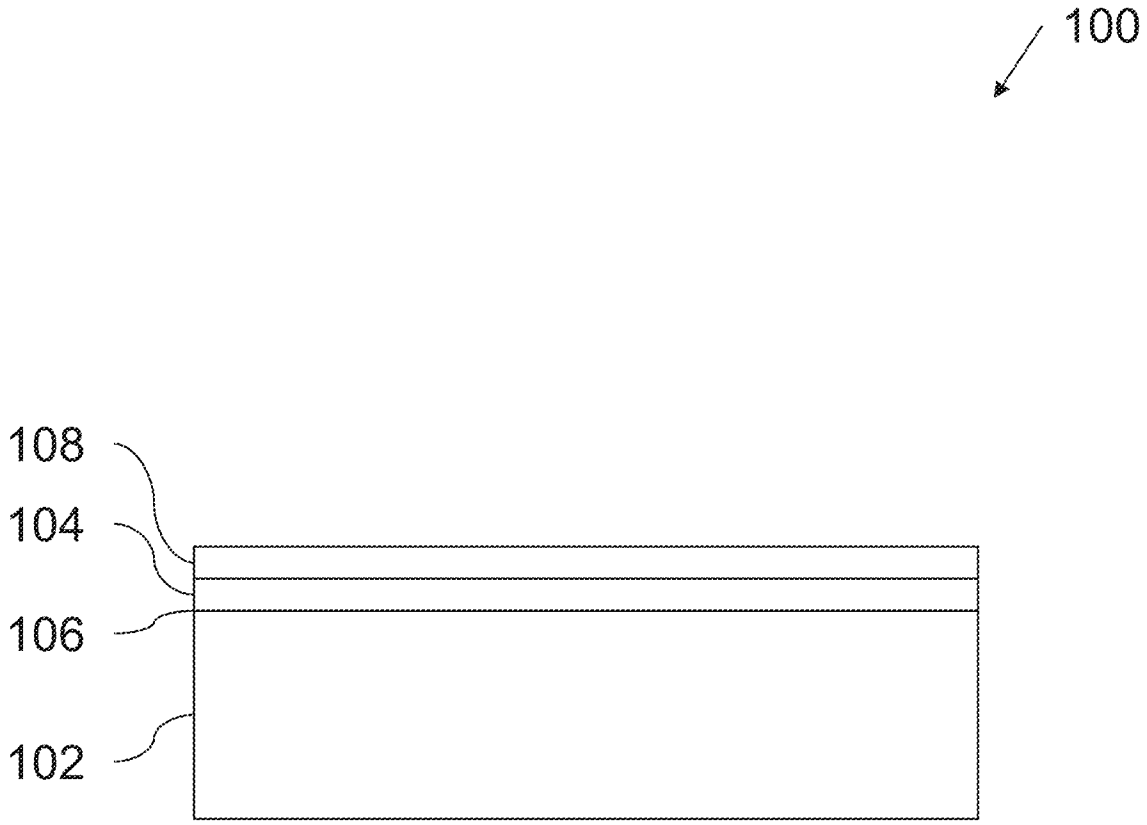
FIG. 1 illustrates a coating on a substrate, in accordance with one embodiment of the present invention.

FIG. 1 illustrates a component 100 with a coating according to one embodiment. Component 100 includes a substrate 102 with a cold spray coating 104 and an anodization layer 108. In one embodiment, the substrate 102 can be a component for use in a semiconductor manufacturing chamber, such as a showerhead, a cathode sleeve, a sleeve liner door, a cathode base, a chamber liner, an electrostatic chuck base, etc. For example, the substrate 102 can be formed from Aluminum, Aluminum alloys (e.g., Al 6061, Al 5058, etc.), stainless steel, Titanium, Titanium alloys, Magnesium, and Magnesium alloys. The chamber component 100 shown is for representational purposes and is not necessarily to scale.

In one embodiment, the average surface roughness of the substrate 102 is adjusted prior to the formation of the cold spray coating 104. For example, an average surface roughness of the substrate 102 may be in a range from about 15 micro-inches to about 300 micro-inches. In one embodiment, the substrate has an average surface roughness that starts at or that is adjusted to about 120 micro-inches. The average surface roughness may be increased (e.g., by bead blasting or grinding), or may be decreased (e.g., by sanding or polishing). However, the average surface roughness of the article may already be suitable for cold spray coating. Accordingly, average surface roughness adjustment can be optional.

The cold spray coating 104 can be formed via a cold spray process. In one embodiment, the cold spray coating can be formed from a metal powder, such as Aluminum (e.g., high purity Aluminum), an Aluminum alloy, Titanium, a Titanium alloy, Niobium, a Niobium alloy, Zirconium, a Zirconium alloy, Copper, or Copper alloys. For example, the cold spray coating 104 can have a thickness in a range from about 0.1 mm to about 40 mm. In one example, the thickness of the cold spray coating is about 1 mm. The cold spray process will be described in more detail below.

In one embodiment, the component 100 can be thermally treated after the application of cold spray coating 104. The thermal treatment can optimize the cold spray coating by improving bonding strength of the cold spray coating 104 to the substrate 102 by a forming a reaction zone 106 between the cold spray coating 104 and the substrate 102.

Subsequently, an anodization layer 108 can be formed from the cold spray layer 104 via an anodization process to seal and protect the cold spray coating 104. In the example where the cold spray coating 104 is formed from Aluminum, the anodization layer 108 can be formed from $Al_2O_3$. The anodization layer 108 can have a thickness in a range from about 2 mil to about 10 mil. In one embodiment, the anodization process is an oxalic or hard anodization process. In one example, the anodization process anodizes between about 20% and about 100% of the cold spray coating 102 to form the anodization layer 108. In one embodiment, about 50% of the cold spray coating 102 is anodized. The anodization process will be described in more detail below.

Further, the cold spray coating 104 can have a relatively high average surface roughness after formation (e.g., having an average surface roughness of about 200 micro-inches). In one embodiment, the average surface roughness of the cold spray coating 104 is altered prior to anodization. For example, the surface of the cold spray coating 104 can be smoothed by chemical mechanical polishing (CMP) or mechanical polishing or other suitable methods. In one example, the average surface roughness of the cold spray coating 104 is altered to have a roughness in a range from about 2-20 micro-inches).

Figure 2:
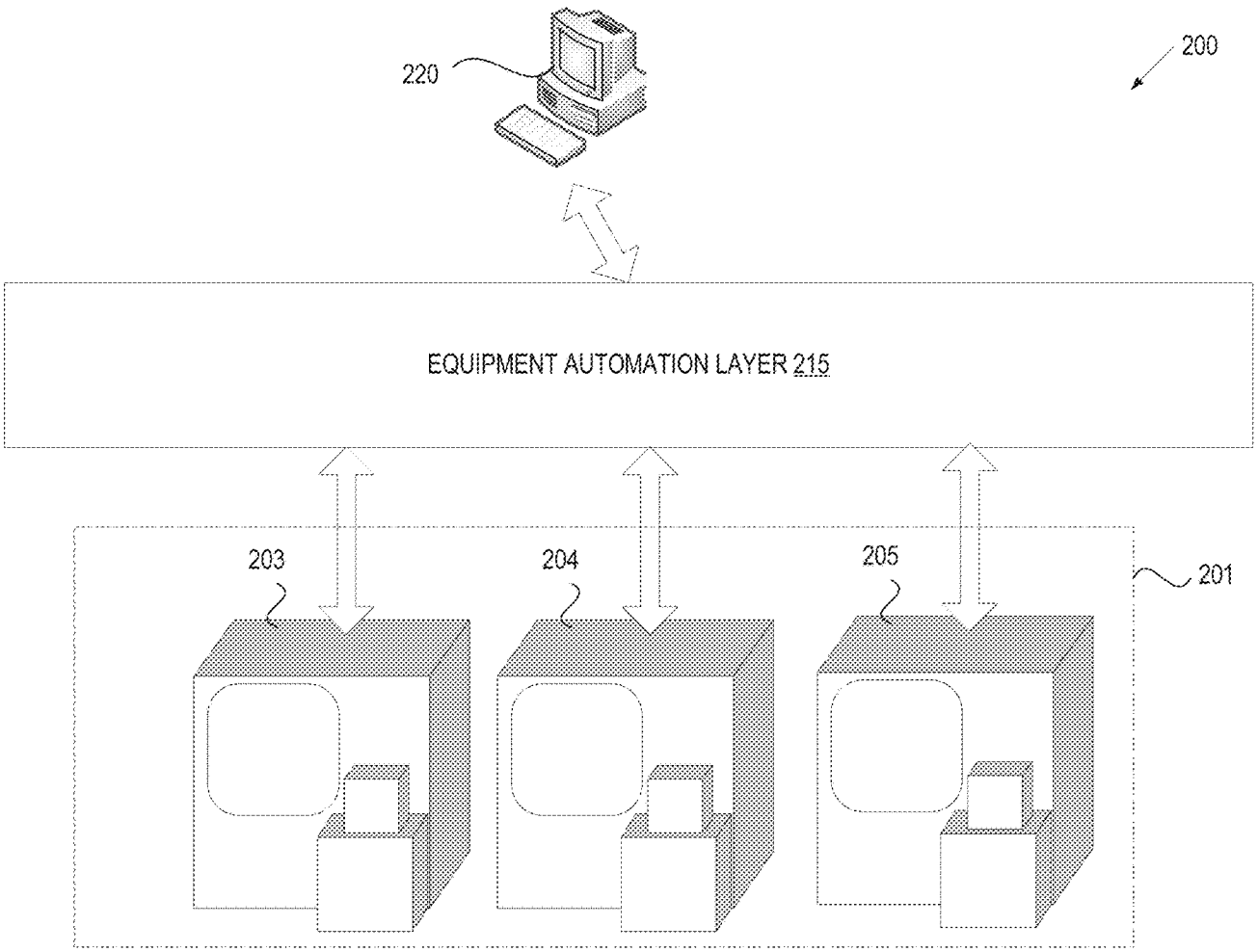
FIG. 2 an exemplary architecture of a manufacturing system, in accordance with one embodiment of the present invention.

FIG. 2 illustrates an exemplary architecture of a manufacturing system 200 for manufacturing a chamber component (e.g., component 100 of FIG. 1). The manufacturing system 200 may be a system for manufacturing an article for use in semiconductor manufacturing, such as a showerhead, a cathode sleeve, a sleeve liner door, a cathode base, a chamber line, or an electrostatic chuck base. In one embodiment, the manufacturing system 200 includes manufacturing machines 201 (e.g., processing equipment) connected to an equipment automation layer 215. The processing equipment 201 may include a cold spray coater 203, a heater 204 and/or an anodizer 205. The manufacturing system 200 may further include one or more computing devices 220 connected to the equipment automation layer 215. In alternative embodiments, the manufacturing system 200 may include more or fewer components. For example, the manufacturing system 200 may include manually operated (e.g., off-line) processing equipment 201 without the equipment automation layer 215 or the computing device 220.

In one embodiment, a wet cleaner cleans the article using a wet clean process where the article is immersed in a wet bath (e.g., after average surface roughness adjustment or prior to coatings or layers being formed). In other embodiments, alternative types of cleaners such as dry cleaners may be used to clean the articles. Dry cleaners may clean articles by applying heat, by applying gas, by applying plasma, and so forth.

Cold spray coater 203 is a system configured to apply a metal coating to the surface of the article. For example, the metal coating can be formed of a metal powder of a metal, such as Aluminum, an Aluminum alloy, Titanium, a Titanium alloy, Niobium, a Niobium alloy, Zirconium, a Zirconium alloy, Copper, or a Copper alloy. In one embodiment, cold spray coater 203 forms an Aluminum coating on the article by a cold spray process where an Aluminum powder is propelled from a nozzle onto the article at a high rate of speed, which will be described in more detail below. Here, surfaces of the article can be coated evenly because the article and/or the nozzle of the cold spray coater 203 can be manipulated to achieve an even coating. In one embodiment, the cold spray coater 203 can have a fixture with a chuck to hold the article during coating. The formation of the cold spray coating will be described in more detail below.

In one embodiment, the article can be baked (or thermally treated) in a heater 204 for certain period after the cold spray coating is formed. The heater 204 may be a gas or electric furnace. For example, the article may be thermally treated for 0.5 hours to 12 hours at a temperature between about 60 degrees C. to about 1500 degrees C., depending on the coating and substrate materials. This thermal treatment may form a reaction zone or barrier layer between the cold spray coating and the article, which can improve bonding of the cold spray coating to the article.

In one embodiment, anodizer 205 is a system configured to form an anodization layer from the cold spray coating. Anodizer 205 may include a current supplier, an anodization bath, and a cathode body. For example, the article, which may be a conductive article, is immersed in the anodization bath. The anodization bath may include sulfuric acid or oxalic acid. An electrical current is applied to the article such that the article acts as an anode and the cathode body acts as a cathode. The anodization layer then forms on the cold spray coating on the article, which will be described in more detail below.

The equipment automation layer 215 may interconnect some or all of the manufacturing machines 201 with computing devices 220, with other manufacturing machines, with metrology tools and/or other devices. The equipment automation layer 215 may include a network (e.g., a location area network (LAN)), routers, gateways, servers, data stores, and so on. Manufacturing machines 201 may connect to the equipment automation layer 215 via a SEMI Equipment Communications Standard/Generic Equipment Model (SECS/GEM) interface, via an Ethernet interface, and/or via other interfaces. In one embodiment, the equipment automation layer 215 enables process data (e.g., data collected by manufacturing machines 201 during a process run) to be stored in a data store (not shown). In an alternative embodiment, the computing device 220 connects directly to one or more of the manufacturing machines 201.

In one embodiment, some or all manufacturing machines 201 include a programmable controller that can load, store and execute process recipes. The programmable controller may control temperature settings, gas and/or vacuum settings, time settings, etc. of manufacturing machines 201. The programmable controller may include a main memory (e.g., read-only memory (ROM), flash memory, dynamic random access memory (DRAM), static random access memory (SRAM), etc.), and/or a secondary memory (e.g., a data storage device such as a disk drive). The main memory and/or secondary memory may store instructions for performing heat treatment processes described herein.

The programmable controller may also include a processing device coupled to the main memory and/or secondary memory (e.g., via a bus) to execute the instructions. The processing device may be a general-purpose processing device such as a microprocessor, central processing unit, or the like. The processing device may also be a special-purpose processing device such as an application specific integrated circuit (ASIC), a field programmable gate array (FPGA), a digital signal processor (DSP), network processor, or the like. In one embodiment, programmable controller is a programmable logic controller (PLC).

Figure 3:
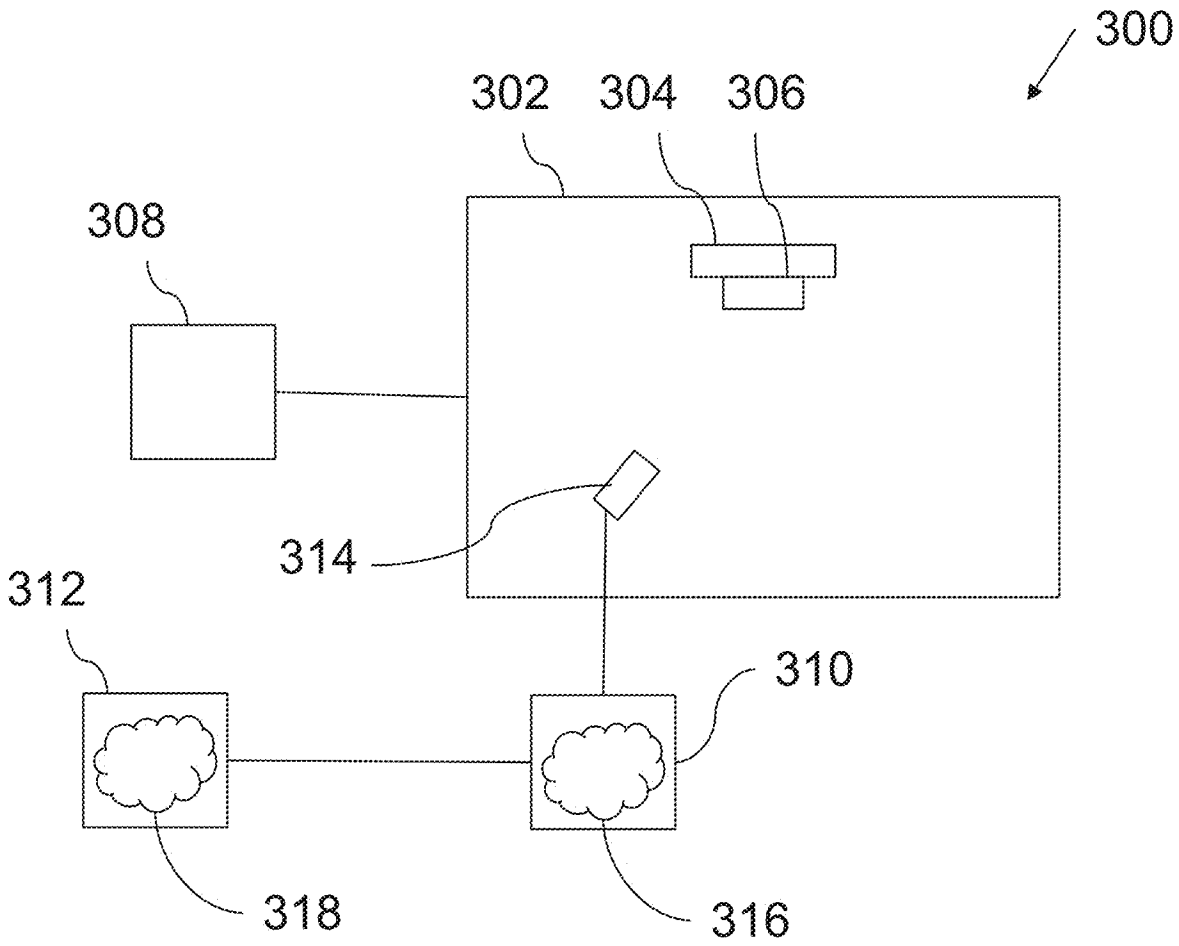
FIG. 3 illustrates a process of applying a coating to a substrate, in accordance with one embodiment of the present invention.

FIG. 3 illustrates an exemplary architecture of a cold spray process manufacturing system 300 for forming a cold spray coating on an article or substrate. The manufacturing system 300 includes a deposition chamber 302, which can include a stage 304 (or fixture) for mounting a substrate 306. In one embodiment, substrate 306 can be substrate 102 of FIG. 1. Air pressure in the deposition chamber 302 can be reduced via a vacuum system 308 to avoid oxidation. A powder chamber 310 containing a metal powder 316, such as Aluminum, an Aluminum alloy, Titanium, a Titanium alloy, Niobium, a Niobium alloy, Zirconium, a Zirconium alloy, Copper, or a Copper alloy, is coupled to a gas container 312 containing a carrier gas 318 for propelling the metal powder 316. A nozzle 314 for directing the metal powder 316 onto the substrate 306 to form the cold spray coating is coupled to the powder chamber 310.

The substrate 306 can be a component used for semiconductor manufacturing. The component may be a component of an etch reactor, or a thermal reactor, of a semiconductor processing chamber, and so forth. Examples of components include a showerhead, a cathode sleeve, a sleeve liner door, a cathode base, a chamber liner, an electrostatic chuck base, etc. The substrate 306 can be formed in part or in whole from Aluminum, Aluminum alloys (e.g., Al 6061, Al 5058, etc.), stainless steel, Titanium, Titanium alloys, Magnesium, and Magnesium alloys, or any other conductive material used in a semiconductor manufacturing chamber component.

In one embodiment, the surface of the substrate 306 can be roughened, prior to formation of the cold spray coating, to an average surface roughness of less than about 100 micro inches to improve adhesion of the coating.

The substrate 306 can be mounted on the stage 304 in the deposition chamber 302 during deposition of a coating. The stage 304 can be moveable stage (e.g., motorized stage) that can be moved in one, two, or three dimensions, and/or rotated/tilted about in one or more directions. Accordingly, the stage 304 can be moved to different positions to facilitate coating of the substrate 306 with metal powder 316 being propelled from the nozzle 314 in a carrier gas. For example, since application of the coating via cold spray is a line of sight process, the stage 304 can be moved to coat different portions or sides of the substrate 306. If the substrate 306 has different sides that need to be coated or a complicated geometry, the stage 304 can adjust the position of the substrate 306 with respect to the nozzle 314 so that the whole assembly can be coated. In other words, the nozzle 314 can be selectively aimed at certain portions of the substrate 306 from various angles and orientations. In one embodiment, the stage 304 can also have cooling or heating channels to adjust the temperature of the article during coating formation.

In one embodiment, the deposition chamber 302 of the manufacturing system 300 can be evacuated using the vacuum system 308, such that a vacuum is present in the deposition chamber 302. For example, pressure within the deposition chamber 302 may be reduced to less than about 0.1 mTorr. Providing a vacuum in the deposition chamber 302 can facilitate application of the coating. For example, the metal powder 316 being propelled from the nozzle encounters less resistance as the metal powder 316 travels to the substrate 306 when the deposition chamber 302 is under a vacuum. Therefore, the metal powder 316 can impact the substrate 306 at a higher rate of speed, which facilitates adherence to the substrate 306 and formation of the coating and can help to reduce the level of the oxidation of the high purity materials like Aluminum.

The gas container 312 holds pressurized carrier gas 318, such as Nitrogen or Argon. The pressurized carrier gas 318 travels under pressure from the gas container 312 to the powder chamber 310. As the pressurized carrier gas 318 travels from the powder chamber 310 to the nozzle 314, the carrier gas 318 propels some of the metal powder 316 towards the nozzle 314. In one example, the gas pressure can be in a range from about 50 to about 1000 Psi. In one example, the gas pressure is about 500 Psi for Aluminum powder. In another example, the gas pressure is less than about 100 Psi for Tin and Zinc powders.

In one embodiment, a gas temperature is in a range from about 100 to about 1000 degrees Celsius (C). In another example, a gas temperature is in a range from about 325 to about 500 degrees C. In one embodiment, a temperature of the gas at the nozzle is in a range from about 120 to about 200 degrees C. The temperature of the metal powder impacting the substrate 306 can depend on the gas temperature, travel speed, and the size of the substrate 306.

In one embodiment, the coating powder 116 has a certain fluidity. In one example, the particles can have a diameter in a range from about 1 microns to about 200 microns. In one example, the particles can have a diameter in a range from about 1 microns to about 50 microns.

As the carrier gas 318 propelling a suspension of the metal powder 316 enters the deposition chamber 302 from an opening in the nozzle 314, the metal powder 316 is propelled towards the substrate 306. In one embodiment, the carrier gas 318 is pressurized such that the coating powder 316 is propelled towards the substrate 306 at a rate of around 100 m/s to about 1500 m/s. For example, the coating powder can be propelled towards the substrate at a rate of around 300 to around 800 msec.

In one embodiment, the nozzle 314 is formed to be wear resistant. Due to the movement of the coating powder 316 through the nozzle 314 at a high velocity, the nozzle 314 can rapidly wear and degrade. However, the nozzle 314 can be formed in a shape and from a material such that wear is minimized or reduced, and or the nozzle can be made as a consumable part. In one embodiment, a nozzle diameter can be in a range from about 1 millimeter (mm) to about 15 mm. In one example, the nozzle diameter can be in a range from about 3 mm to about 12 mm. For example, the nozzle diameter can be about 6.3 mm for Aluminum powder. In one embodiment, the nozzle stand-off (i.e., the distance from the nozzle 314 to the substrate 306) can be in a range from about 5 mm to about 200 mm. For example, the nozzle stand-off can be in a range from about 10 mm to about 50 mm.

Upon impacting the substrate 306, the particles of the metal powder 316 fracture and deform from the kinetic energy to produce an anchor layer that adheres to the substrate 306. As the application of the metal powder 316 continues, the particles become a cold spray coating or film by bonding to themselves. The cold spray coating on the substrate 306 continues to grow by continuous collision of the particles of the coating powder 316 on the substrate 306. In other words, the particles are mechanically colliding with each other and the substrate at a high speed to break into smaller pieces to form a dense layer. Notably, with cold spraying the particles may not melt and reflow.

In one embodiment, the particle crystal structure of the particles of the metal powder 316 remains after application to the substrate 306. In one embodiment, partial melting can happen when kinetic energy converts to thermal energy due to the particles breaking into smaller pieces upon impacting the substrate 306. These particles may become densely bonded. As mentioned, the temperature of the metal powder on the substrate 306 can depend on the gas temperature, travel speed, and the size (e.g., the thermal mass) of the substrate 306.

In one embodiment, a coating deposition rate can be in a range from about 1 to about 50 grams/min. For example, the coating deposition rate can be in a range from about 1 to about 20 grams/min for Aluminum powder. Denser coatings can be achieved by a slower feed and faster raster (i.e., travel speed). In one embodiment, efficiency is in a range from about 10 percent to about 90 percent. For example, efficiency can be in a range from about 30 percent to about 70 percent. Higher temperature and higher gas pressure can lead to higher efficiency.

In one embodiment, an average surface roughness of the coating may be increased (e.g., by bead blasting or grinding), or may be decreased (e.g., by sanding or polishing) to achieve an average surface roughness in a range from about 2 micro-inches to about 300 micro-inches, with a surface roughness of about 120 micro-inches in one particular embodiment. For example, the coating can be bead blasted with $Al_2O_3$ particles with a diameter in a range from about 20 microns to about 300 microns. In one example, the particles can have a diameter in a range from about 100 microns to about 150 microns. In one embodiment, between about 10 percent and about 50 percent of the coating may be removed during adjustment of the average surface roughness. However, the average surface roughness of the article may already be suitable, so average surface roughness adjustment can be optional.

Unlike application of a coating via plasma spray (which is a thermal technique performed at elevated temperatures), application of a cold spray coating via one embodiment can be performed at room-temperature or near room temperature. For example, application of the cold spray coating can be performed at around 15 degrees C. to about 100 degrees C., depending on the gas temperature, travel speed, and size of the component. In the case of a cold spray deposition, the substrate may not be heated and the application process does not significantly increase the temperature of the substrate being coated.

Furthermore, coatings according to embodiments may have few or no oxide inclusions and low porosity due to solidification shrinkages.

In one embodiment, the cold spray coating can be very dense, e.g., greater than about 99% density. Further, the cold spray coating can have good adhesion to the substrate without inter-layers, e.g. about 4,500 psi for Aluminum coatings.

Typically, there is little or no thermally-induced difference between the powder and the cold spray coating. In other words, what is in the powder is in the coating. Also, typically there is little or no damage to the microstructure of the substrate or component during cold spray coating. Also, the cold spray coating generally exhibits a high hardness and a cold work microstructure. A high amount of cold work occurs by heavy plastic deformation of the ductile coating materials, which results in a very fine grain structure that can be beneficial for mechanical and corrosion properties of the coating.

Cold spray coating is generally in the compression mode which helps to reduce delamination of the coating or macro or microscopic cracking in the coating layer.

In one embodiment, gradient deposits can be used to achieve a composite layer with desired mechanical and corrosion properties. For example, an Aluminum layer is first deposited and a Copper layer is deposited on top of the Aluminum layer.

In one embodiment, the coated substrate 306 can be subjected to a post-coating process. The post cleaning process may be a thermal treatment, which can further control a coating interface between the coating and the substrate to improve adhesion and/or create a barrier layer or reaction zone. In one embodiment, the coated substrate can be heated to a temperature in a range from about 200 degrees C. to about 1450 degrees C. for more than about 30 minutes. For example, a Y layer can be heated to about 750 degrees C. to oxidize the surface of the Y layer to $Y_2O_3$, thus improving erosion resistance.

In one embodiment, the formation of a barrier layer or reaction zone between a coating and a substrate prohibits the reaction of process chemistry that penetrates the coating with an underlying substrate. This may minimize the occurrence of delamination. The reaction zone may increase adhesion strength of the ceramic coating, and may minimize peeling. For example, the barrier layer can be an intermetallic compound or a solid solution region formed between two materials, such an AlTi intermetallic or solid solution between an Al layer and a Ti layer.

The reaction zone grows at a rate that is dependent upon temperature and time. As temperature and heat treatment duration increase, the thickness of the reaction zone also increases. Accordingly, the temperature (or temperatures) and the duration used to heat treat the component should be chosen to form a reaction zone that is not thicker than around 5 microns. In one embodiment, the temperature and duration are selected to cause a reaction zone of about 0.1 microns to about 5 microns to be formed. In one embodiment, the reaction zone has a minimum thickness that is sufficient to prevent gas from reacting with the ceramic substrate during processing (e.g., around 0.1 microns). In one embodiment, the barrier layer has a target thickness of 1-2 microns.

Figure 4:
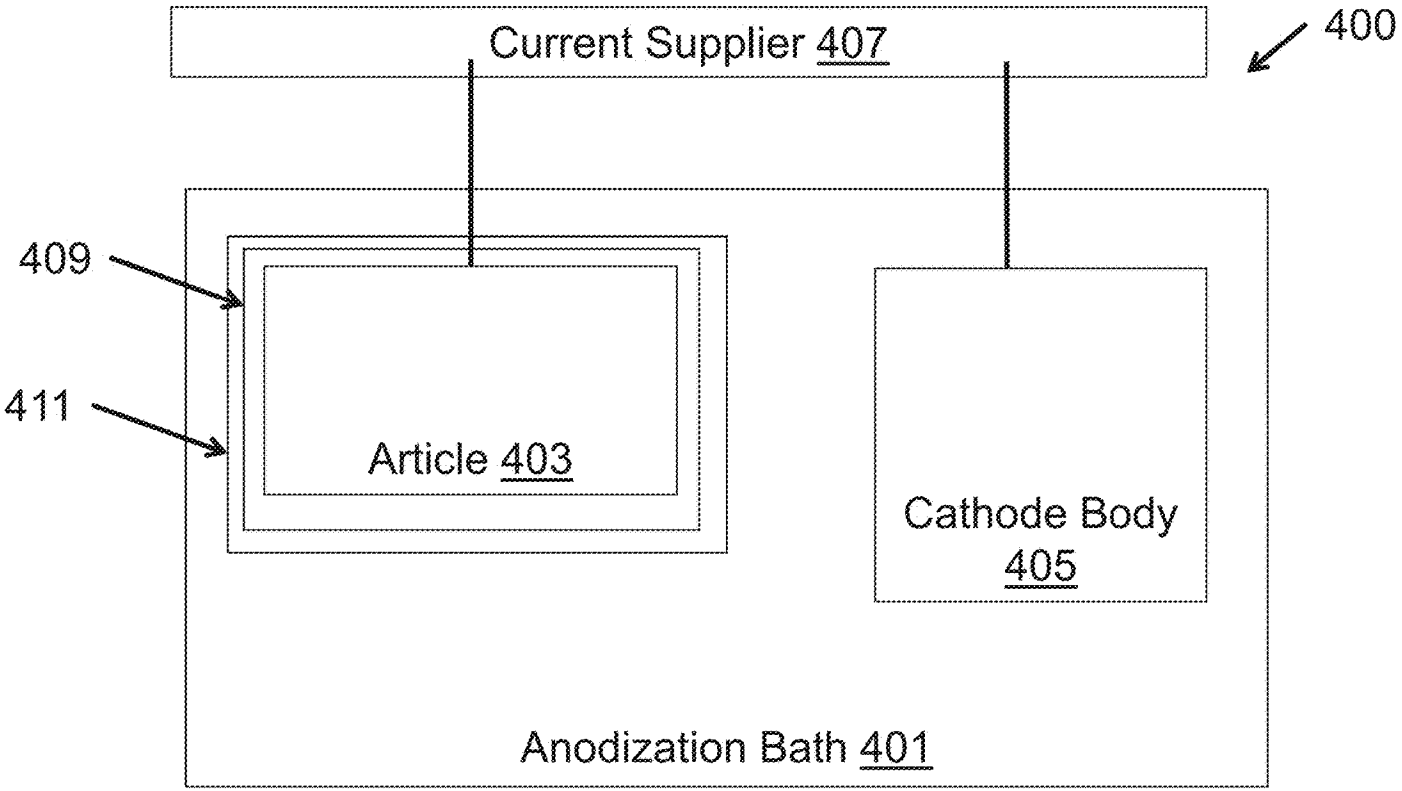
FIG. 4 illustrates a process of anodizing a coating on a substrate, in accordance with one embodiment of the present invention.

FIG. 4 illustrates a process 400 for anodizing an article 403 to form an anodization layer 411 from a cold spray coating 409, according to one embodiment. For example, article 403 can be substrate 102 of FIG. 1. Anodization changes the microscopic texture of the surface of the article 403. Accordingly, FIG. 4 is for illustration purposes only and may not be to scale. Preceding the anodization process, the article 403 can be cleaned in a nitric acid bath. The cleaning may perform deoxidation prior to anodization.

The article 403 with cold spray coating 409 is immersed in an anodization bath 401 along with a cathode body 405. The anodization bath may include an acid solution. Examples of cathode bodies for anodizing an Aluminum coating include Aluminum alloys such as Al6061 and Al3003 as well as carbon bodies. The anodization layer 411 is grown from the cold spray coating 409 on the article 403 by passing a current through an electrolytic or acid solution via a current supplier 407, where the article 403 is the anode (the positive electrode). The current supplier 407 may be a battery or other power supply. The current releases hydrogen at the cathode body 405 (the negative electrode) and oxygen at the surface of the cold spray coating 409 to form an anodization layer 411 over the cold spray coating 409. The anodization layer is Aluminum Oxide in the case of an Aluminum cold spray coating 409. In one embodiment, the voltage that enables anodization using various solutions may range from 1 to 300 V. In one embodiment, the voltage ranges from 15 to 21 V. The anodizing current varies with the area of the cathode body 405 (e.g., aluminum body) anodized, and can range from 30 to 300 amperes/meter$^2$ (2.8 to 28 ampere/ft$^2$).

The acid solution dissolves (i.e., consumes or converts) a surface of the cold spray coating 409 to form a layer of pores (e.g., columnar nanopores). The anodization layer 411 continues growing from this layer of nanopores. The nanopores may have a diameter in a range from about 10 nm to about 50 nm. In one embodiment, the nanopores have an average diameter of about 30 nm.

The acid solution can be oxalic acid, sulfuric acid, a combination of oxalic acid and sulfuric acid. For oxalic acid, the ratio of consumption of the article to anodization layer growth is about 1:1. Electrolyte concentration, acidity, solution temperature, and current are controlled to form a consistent Aluminum oxide anodization layer 411 from cold spray coating 409. In one embodiment, the anodization layer can be grown to have a thickness in a range from about 300 nm to about 200 microns. In one embodiment, the formation of the anodization layer consumes a percentage of the cold spray coating in a range from about 5 percent to about 100 percent. In one example, the formation of the anodization layer consumes about 50 percent of the cold spray coating.

In one embodiment, the current density is initially high (>99%) to grow a very dense (>99%) barrier layer portion of the anodization layer, and then current density is reduced to grow a porous columnar layer portion of the anodization layer. In one embodiment where oxalic acid is used to form the anodization layer, the porosity is in a range from about 40% to about 50%, and the pores have a diameter in a range from about 10 nm to about 50 nm.

In one embodiment, the average surface roughness (Ra) of the anodization layer is in a range from about 15 micro-inch to about 300 micro-inch, which can be similar to the initial roughness of the article. In one embodiment, the average surface roughness is about 120 micro-inches.

Table A shows the results of Induction Coupled Plasma Mass Spectroscopy (ICP-MS) used to detect metallic impurities in an Al6061 article and an anodized cold spray high purity Al coating on an Al6061 article. In this example, the anodized cold spray high purity Al coating on an Al6061 article showed significantly less trace metal contamination than a 6061 Al component without a coating.

TABLE A

| Surface Concentration ($\times 10^{10}$ atoms/cm$^2$) | | | | |
|---|---|---|---|---|
| | | Method Detection Limit | 6061 Anodized Aluminum | Cold Spray Anodized pure Aluminum |
| Aluminum | (Al) | 50 | 81,000 | 45,000 |
| Antimony | (Sb) | 0.5 | 1.7 | 0.67 |
| Arsenic | (As) | 5 | <5 | <5 |
| Barium | (Ba) | 10 | <10 | <10 |
| Beryllium | (Be) | 30 | <30 | <30 |
| Bismuth | (Bi) | 0.5 | <0.5 | <0.5 |
| Boron | (B) | 200 | 550 | <200 |
| Cadmium | (Cd) | 1 | <1 | <1 |
| Calcium | (Ca) | 70 | 1,100 | <70 |
| Chromium | (Cr) | 20 | 43 | <20 |
| Cobalt | (Co) | 5 | <5 | <5 |
| Copper | (Cu) | 10 | 310 | 190 |
| Gallium | (Ga) | 1 | 6.1 | <1 |
| Germanium | (Ge) | 10 | <10 | <10 |
| Iron | (Fe) | 20 | 120 | 270 |
| Lead | (Pb) | 3 | <3 | 22 |
| Lithium | (Li) | 20 | 80 | <20 |
| Magnesium | (Mg) | 50 | 130 | <50 |
| Manganese | (Mn) | 5 | 8.0 | <5 |
| Molybdenum | (Mo) | 2 | <2 | <2 |
| Nickel | (Ni) | 10 | 360 | 18 |
| Potassium | (K) | 50 | 250 | <50 |
| Sodium | (Na) | 50 | 170 | 51 |
| Strontium | (Sr) | 5 | <5 | <5 |
| Tin | (Sn) | 5 | <5 | <5 |
| Titanium | (Ti) | 20 | 72 | <20 |
| Tungsten | (W) | 2 | <2 | <2 |
| Vanadium | (V) | 5 | 7.6 | <5 |
| Zinc | (Zn) | 20 | 750 | 120 |
| Zirconium | (Zr) | 0.5 | 24 | 1.2 |

Figure 5:
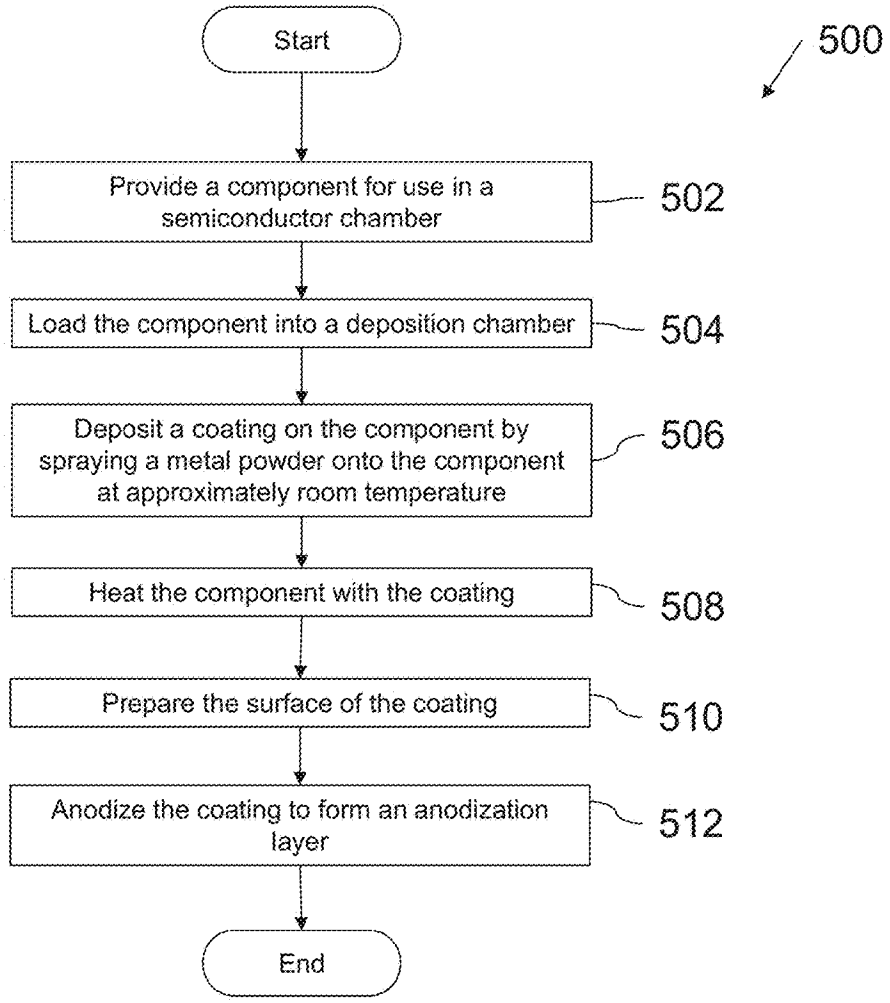
FIG. 5 illustrates a method of forming a coating on a substrate, in accordance with one embodiment of the present invention.

FIG. 5 is a flow chart showing a method 500 for manufacturing a coated component, in accordance with embodiments of the present disclosure. Method 500 may be performed using the manufacturing system 200 of FIG. 2.

At block 502, a component for use in a semiconductor manufacturing environment is provided. For example, the component can be a substrate, as described above, such as a showerhead, a cathode sleeve, a sleeve liner door, a cathode base, a chamber liner, an electrostatic chuck base, etc. For example, the substrate can be formed from Aluminum, Aluminum alloys (e.g., Al 6061, Al 5058, etc.), stainless steel, Titanium, Titanium alloys, Magnesium, and Magnesium alloys.

At block 504, the component is loaded into a deposition chamber. The deposition chamber can be deposition chamber 302 described above.

At block 506, a cold spray coating is coated on the component by spraying a nanoparticle metal powder onto the component, where the cold spray coating can have a thickness in a range from about 0.5 mm to about 2 mm. For example, the metal powder can include Aluminum (e.g., high purity Aluminum), an Aluminum alloy, Titanium, a Titanium alloy, Niobium, a Niobium alloy, Zirconium, a Zirconium alloy, Copper, or Copper alloys. The metal powder may be suspended in a gas such as Nitrogen or Argon.

At block 508, the method further includes thermally treating the coated component to form a reaction zone or barrier layer between the component and the coating, according to one embodiment. For example, the coated component can be heated to 1450 degrees C. for more than 30 minutes.

At block 510, the method further includes preparing the surface of the component, according to one embodiment. For example, the cold spray coating may have an average surface roughness that is not ideal. Thus, the average surface roughness of the cold spray coating can be smoothed to lower the average surface roughness (e.g., by polishing) or roughened to raise the average surface roughness (e.g., by bead blasting or grinding).

At block 512, the cold spray coating is anodized to form an anodization layer. In an example where the cold spray coating is Aluminum, the anodization layer can be Aluminum Oxide, and the formation of the anodization layer can consume a percentage of the cold spray coating in a range from about 5 percent to about 100 percent.

The preceding description sets forth numerous specific details such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or."

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner.

It is to be understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which such claims are entitled.

What is claimed is:

1. An article comprising:

a component for a manufacturing chamber;

a coating on the component; and an anodization layer formed on the coating, the anodization layer having a thickness of about 2-10 mil, wherein the anodization layer comprises a low porosity layer portion having a porosity that is less than about 40-50% and a porous columnar layer portion having a porosity of about 40-50% and comprising a plurality of columnar nanopores having a diameter of about 10-50 nm.

2. The article of claim 1, wherein the coating has an average surface roughness of less than about 20 micro-inch.

3. The article of claim 1, wherein the article further comprises a barrier layer between the component and the coating.

4. The article of claim 3, wherein the barrier layer has a thickness in a range of about 0.1-5.0 microns.

5. The article of claim 3, wherein the article comprises a first one of Aluminum or Titanium, wherein the coating comprises a second one of Aluminum or Titanium, and wherein the barrier layer comprises a solid solution of Aluminum and Titanium.

6. The article of claim 1, wherein the component comprises at least one of Aluminum, an Aluminum alloy, stainless steel, Titanium, a Titanium alloy, Magnesium, or a Magnesium alloy.

7. The article of claim 1, wherein the coating comprises Aluminum, an Aluminum alloy, Titanium, a Titanium alloy, Niobium, a Niobium alloy, Zirconium, a Zirconium alloy, Copper, or a Copper alloy.

8. The article of claim 1, wherein the component is a showerhead, a cathode sleeve, a sleeve liner door, a cathode base, a chamber line, or an electrostatic chuck base.

9. The article of claim 1, wherein the component has an average surface roughness of about 120 micro-inches.

10. The article of claim 1, wherein the coating comprises a gradient of a first metal and a second metal.

11. The article of claim 1, wherein the coating has a thickness of about 0.2-5.0 mm.

12. The article of claim 1, wherein the coating is devoid of oxide inclusions.

13. An article comprising a component in a manufacturing chamber, a coating on a surface of the component, and an anodization layer on the coating, the article having been manufactured by a process comprising:

depositing a coating onto the surface of the article; and anodizing the coating to form the anodization layer, the anodization layer having a thickness of about 2-10 mil, wherein the anodization layer comprises a plurality of columnar nanopores having a diameter of about 10-50 nm, wherein at least a portion of the anodization layer has a porosity of about 40-50%, and wherein anodizing the coating comprises:

applying a first current density during a start of the anodizing to form a low porosity layer portion of the anodization layer, the low porosity layer portion having a porosity that is less than the porosity of about 40-50%; and applying a second current density that is lower than the first current density during a remainder of the anodizing to form a porous columnar layer portion of the anodization layer, the porous columnar layer portion comprising the plurality of columnar nanopores and having the porosity of about 40-50%.

14. The article of claim 13, wherein the coating comprises at least one of Aluminum, an Aluminum alloy, Titanium, a Titanium alloy, Niobium, a Niobium alloy, Zirconium, a Zirconium alloy, Copper, or a Copper alloy.

15. The article of claim 13, the process further comprising:

performing chemical mechanical polishing (CMP) of the coating to cause the coating to have an average surface roughness of less than about 20 micro-inch prior to anodizing the coating.

16. The article of claim 13, the process further comprising:

forming a barrier layer between the article and the coating by heating the article after the coating to a temperature in a range from about 200 degrees C. to about 1450 degrees C. for more than about 30 minutes, wherein the barrier layer has a thickness of about 0.5-5.0 microns.

17. The article of claim 13, wherein the coating has a thickness in a range from about 0.1 mm to about 40 mm.

18. The article of claim 13, wherein the article is a showerhead of a semiconductor manufacturing chamber, a cathode sleeve, a sleeve liner door, a cathode base, a chamber line, or an electrostatic chuck base.

19. The article of claim 13, wherein the coating comprises a mixture of a first metal and a second metal, and wherein depositing the coating comprises adjusting a percentage of the first metal and the second metal to cause the coating to have a gradient of the first metal and the second metal.

* * * * *